US008076522B2

(12) United States Patent
Clark et al.

(10) Patent No.: US 8,076,522 B2
(45) Date of Patent: Dec. 13, 2011

(54) FUEL COMPOSITIONS

(75) Inventors: Richard Hugh Clark, Chester (GB); John Nicholas Davenport, Chester (GB); Jurgen Jacobus Johannes Louis, Hamburg (DE)

(73) Assignee: Shell Oil Company, Houston, TX (US)

( * ) Notice: Subject to any disclaimer, the term of this patent is extended or adjusted under 35 U.S.C. 154(b) by 627 days.

(21) Appl. No.: 11/506,273

(22) Filed: Aug. 11, 2006

(65) Prior Publication Data

US 2007/0100177 A1 May 3, 2007

(30) Foreign Application Priority Data

Aug. 12, 2005 (EP) ..... 05017600

(51) Int. Cl.
*C10L 1/08* (2006.01)

(52) U.S. Cl. ..... 585/14; 208/15; 208/950; 518/700

(58) Field of Classification Search ..... 585/14; 44/385; 208/15, 950; 518/700
See application file for complete search history.

(56) References Cited

U.S. PATENT DOCUMENTS

2005/0086854 A1* 4/2005 Millington et al. ..... 44/385

FOREIGN PATENT DOCUMENTS

| | | | |
|---|---|---|---|
| WO | WO 00/20535 | * | 4/2000 |
| WO | WO0020535 | | 4/2000 |
| WO | WO 00/60029 | * | 10/2000 |
| WO | 03/087272 A1 | | 10/2003 |
| WO | WO03087273 | * | 10/2003 |
| WO | WO2005021688 | | 3/2005 |
| WO | WO2005026297 | | 3/2005 |

OTHER PUBLICATIONS

Florida Department of Environmental Protection, "List of Commonly Encountered Petroleum and Petroleum Products," May 11, 2006; pp. 1-6. (http://www.dep.state.fl.us/waste/quick_topics/publications/pss/pcp/PetroleumProductDescriptions.pdf).

Owen, et al., "Automotive Fuels Reference Book," 2nd Ed., 1995; Chapter 3, Figure 3.1 [1 page].

* cited by examiner

*Primary Examiner* — Michael Marcheschi
*Assistant Examiner* — Chantel Graham

(57) ABSTRACT

A fuel composition exhibiting a reduced acceleration time, the fuel composition comprising a blend comprising a non-Fischer-Tropsch derived diesel base fuel and from about 0.2 v/v % to 3 v/v % Fischer-Tropsch derived kerosene fuel product, the blend exhibiting a reduced acceleration time that is at least 0.20% less than a theoretical acceleration time.

21 Claims, No Drawings

FUEL COMPOSITIONS

CROSS REFERENCE TO RELATED APPLICATIONS

This application claims priority of European Application No. 05017600.7 filed in the European patent office on Aug. 12, 2005.

FIELD OF THE INVENTION

The present invention relates to diesel fuel compositions and to their preparation and uses, as well as to the use of certain types of fuel in fuel compositions.

BACKGROUND OF THE INVENTION

Typical diesel fuels comprise liquid hydrocarbon middle distillate fuel oils having boiling points from about 150 to 400° C. Conventionally they are petroleum derived.

Gas oil reaction products of Fischer-Tropsch methane condensation processes, for example the process known as Shell Middle Distillate Synthesis (van der Burgt et al, "The Shell Middle Distillate Synthesis Process", paper delivered at the 5th Synfuels Worldwide Symposium, Washington D.C., November 1985; see also the November 1989 publication of the same title from Shell International Petroleum Company Ltd, London, UK) can be used as diesel fuels.

SUMMARY OF THE INVENTION

In one embodiment of the invention, a fuel composition comprising a blend of a non-Fischer-Tropsch derived diesel base fuel and a Fischer-Tropsch derived kerosene fuel product is provided.

A process for providing such fuel composition and use thereof is also provided.

DETAILED DESCRIPTION OF THE INVENTION

These Fischer-Tropsch derived gas oils, known as GTL ("Gas-To-Liquid") diesel fuels, are low in undesirable fuel components such as sulphur, nitrogen and aromatics and also have lower densities than their petroleum derived counterparts. As a result, they can be blended with conventional petroleum derived diesel fuels to reduce vehicle emissions, in particular particulates and black smoke, levels of such emissions being closely linked with fuel density.

It has now been found that GTL fractions other than gas oils can successfully be blended with conventional refinery diesel fuels to yield a fuel composition with desirable properties.

According to a first aspect of the present invention, there is provided a fuel composition containing a blend of a non-Fischer-Tropsch derived diesel base fuel and a Fischer-Tropsch derived kerosene fuel product.

The composition preferably also contains a Fischer-Tropsch derived gas oil as a blend component.

The fuel composition is preferably an automotive fuel composition, more preferably for use in an internal combustion engine. Most preferably it is a diesel fuel composition.

The non-Fischer-Tropsch derived diesel base fuel will typically be a petroleum derived diesel (i.e. gas oil) base fuel, but in general it may be any suitable liquid hydrocarbon middle distillate fuel oil whether or not petroleum derived. Such fuels will typically have boiling points within the usual diesel range of 150 to 400° C., depending on grade and use. The base fuel may be organically or synthetically derived, as long as it is not Fischer-Tropsch derived.

The base fuel will typically have a density from 0.75 to 0.9 g/cm$^3$, preferably from 0.8 to 0.86 g/cm$^3$, at 15° C. (e.g. ASTM D4502 or IP 365) and a cetane number (as measured by either ASTM D613 or IP 498 [IQT]) of from 35 to 80, more preferably from 40 to 75. It will typically have an initial boiling point in the range 150 to 230° C. and a final boiling point in the range 290 to 400° C. Its kinematic viscosity at 40° C. (ASTM D445) might suitably be from 1.5 to 4.5 centistokes.

A petroleum derived gas oil may be obtained from refining and optionally (hydro)processing a crude petroleum source. It may be a single gas oil stream obtained from such a refinery process or a blend of several gas oil fractions obtained in the refinery process via different processing routes. Examples of such gas oil fractions are straight run gas oil, vacuum gas oil, gas oil as obtained in a thermal cracking process, light and heavy cycle oils as obtained in a fluid catalytic cracking unit and gas oil as obtained from a hydrocracker unit. Optionally a petroleum derived gas oil may comprise some petroleum derived kerosene fraction.

An example of a petroleum derived gas oil is a Swedish Class 1 base fuel, which will have a density from 0.800 to 0.820 g/cm$^3$ at 15° C. (ASTM D4502 or IP 365), a cetane number (IP 498 [IQT]) of greater than 51, a T95 of 285° C. or less (ASTM D86 or IP 123) and a kinematic viscosity at 40° C. (ASTM D445) from 1.2 to 4.0 centistokes, as defined by the Swedish national specification EC1.

Such gas oils may be processed in a hydrodesulphurisation (HDS) unit so as to reduce their sulphur content to a level suitable for inclusion in a diesel fuel composition.

In a fuel composition according to the present invention, the base fuel may itself comprise a mixture of two or more diesel fuel components of the types described above. It may also contain or consist of a vegetable oil or other so-called "biodiesel" fuel.

By "Fischer-Tropsch derived" is meant that a fuel is, or derives from, a synthesis product of a Fischer-Tropsch condensation process. The term "non-Fischer-Tropsch derived" may be interpreted accordingly. A Fischer-Tropsch derived fuel may also be referred to as a GTL fuel.

The Fischer-Tropsch reaction converts carbon monoxide and hydrogen into longer chain, usually paraffinic, hydrocarbons:

$$n(CO+2H_2)=(-CH_2-)_n+nH_2O+\text{heat},$$

in the presence of an appropriate catalyst and typically at elevated temperatures (e.g. 125 to 300° C., preferably 175 to 250° C.) and/or pressures (e.g. 5 to 100 bar, preferably 12 to 50 bar). Hydrogen:carbon monoxide ratios other than 2:1 may be employed if desired.

The carbon monoxide and hydrogen may themselves be derived from organic or inorganic, natural or synthetic sources, typically either from natural gas or from organically derived methane.

Gas oil and kerosene products may be obtained directly from the Fischer-Tropsch reaction, or indirectly for instance by fractionation of Fischer-Tropsch synthesis products or from hydrotreated Fischer-Tropsch synthesis products. Hydrotreatment can involve hydrocracking to adjust the boiling range (see, e.g., GB-B-2077289 and EP-A-0147873) and/or hydroisomerisation which can improve cold flow properties by increasing the proportion of branched paraffins. EP-A-0583836 describes a two step hydrotreatment process in which a Fischer-Tropsch synthesis product is firstly subjected to hydroconversion under conditions such that it undergoes substantially no isomerisation or hydrocracking (this hydrogenates the olefinic and oxygen-containing components), and then at least part of the resultant product is hydroconverted under conditions such that hydrocracking and isomerisation occur to yield a substantially paraffinic hydrocarbon fuel. The desired gas oil fraction(s) may subsequently be isolated for instance by distillation.

Other post-synthesis treatments, such as polymerisation, alkylation, distillation, cracking-decarboxylation, isomerisation and hydroreforming, may be employed to modify the properties of Fischer-Tropsch condensation products, as described for instance in U.S. Pat. No. 4,125,566 and U.S. Pat. No. 4,478,955.

Typical catalysts for the Fischer-Tropsch synthesis of paraffinic hydrocarbons comprise, as the catalytically active component, a metal from Group VIII of the periodic table, in particular ruthenium, iron, cobalt or nickel. Suitable such catalysts are described for instance in EP-A-0583836 (pages 3 and 4).

An example of a Fischer-Tropsch based process is the SMDS (Shell Middle Distillate Synthesis) described in "The Shell Middle Distillate Synthesis Process", van der Burgt et al (supra). This process (also sometimes referred to as the Shell "Gas-To-Liquids" or "GTL" technology) produces middle distillate range products by conversion of a natural gas (primarily methane) derived synthesis gas into a heavy long chain hydrocarbon (paraffin) wax which can then be hydroconverted and fractionated to produce liquid transport fuels such as the gas oils useable in diesel fuel compositions. A version of the SMDS process, utilising a fixed bed reactor for the catalytic conversion step, is currently in use in Bintulu, Malaysia and its gas oil products have been blended with petroleum derived gas oils in commercially available automotive fuels.

Gas oils and kerosenes prepared by the SMDS process are commercially available for instance from Shell companies. Further examples of Fischer-Tropsch derived gas oils are described in EP-A-0583836, EP-A-1101813, WO-A-97/14768, WO-A-97/14769, WO-A-00/20534, WO-A-00/20535, WO-A-00/11116, WO-A-00/11117, WO-A-01/83406, WO-A-01/83641, WO-A-01/83647, WO-A-01/83648 and U.S. Pat. No. 6,204,426.

By virtue of the Fischer-Tropsch process, a Fischer-Tropsch derived fuel has essentially no, or undetectable levels of, sulphur and nitrogen. Compounds containing these heteroatoms tend to act as poisons for Fischer-Tropsch catalysts and are therefore removed from the synthesis gas feed. This can yield additional benefits, in terms of effect on catalyst performance, in fuel compositions in accordance with the present invention.

Further, the Fischer-Tropsch process as usually operated produces no or virtually no aromatic components. The aromatics content of a Fischer-Tropsch derived fuel, suitably determined by ASTM D4629, will typically be below 1% w/w, preferably below 0.5% w/w and more preferably below 0.1% w/w.

Generally speaking, Fischer-Tropsch derived fuels have relatively low levels of polar components, in particular polar surfactants, for instance compared to petroleum derived fuels. It is believed that this can contribute to improved antifoaming and dehazing performance. Such polar components may include for example oxygenates, and sulphur and nitrogen containing compounds. A low level of sulphur in a Fischer-Tropsch derived fuel is generally indicative of low levels of both oxygenates and nitrogen containing compounds, since all are removed by the same treatment processes.

A Fischer-Tropsch derived kerosene fuel is a liquid hydrocarbon middle distillate fuel with a distillation range suitably from 140 to 260° C., preferably from 145 to 255° C., more preferably from 150 to 250° C. or from 150 to 210° C. It will have a final boiling point of typically from 190 to 260° C., for instance from 190 to 210° C. for a typical "narrow-cut" kerosene fraction or from 240 to 260° C. for a typical "full-cut" fraction. Its initial boiling point is preferably from 140 to 160° C., more preferably from 145 to 160° C. Again, Fischer-Tropsch derived kerosenes tend to be low in undesirable fuel components such as sulphur, nitrogen and aromatics.

A Fischer-Tropsch derived kerosene fuel preferably has a density of from 0.730 to 0.760 g/cm$^3$ at 15° C.—for instance from 0.730 to 0.745 g/cm$^3$ for a narrow-cut fraction and from 0.735 to 0.760 g/cm$^3$ for a full-cut fraction. It preferably has a sulphur content of 5 ppmw (parts per million by weight) or less. In particular, it has a cetane number of from 63 to 75, for example from 65 to 69 for a narrow-cut fraction, and from 68 to 73 for a full cut fraction. It is preferably the product of a SMDS process, preferred features of which may be as described below in connection with Fischer-Tropsch derived gas oils.

The Fischer-Tropsch derived kerosene fuel product as used in the present invention is that produced as a distinct finished product, that is suitable for sale and use in applications that require the particular characteristics of a kerosene fuel. In particular, it exhibits a distillation range falling within the range normally relating to Fischer-Tropsch derived kerosene fuels, as set out above.

A fuel composition according to the invention may include a mixture of two or more Fischer-Tropsch derived kerosene fuel products.

A Fischer-Tropsch derived gas oil should be suitable for use as a diesel fuel; its components (or the majority, for instance 95% w/w or greater, thereof) should therefore have boiling points within the typical diesel fuel ("gas oil") range, i.e. from about 150 to 400° C. or from 170 to 370° C. It will suitably have a 90% w/w distillation temperature of from 300 to 370° C.

Suitably, in accordance with the present invention, a Fischer-Tropsch derived gas oil will consist of at least 70% w/w, preferably at least 80% w/w, more preferably at least 90% w/w, most preferably at least 95% w/w, of paraffinic components, preferably iso- and linear paraffins. The weight ratio of iso-paraffins to normal paraffins will suitably be greater than 0.3 and may be up to 12; suitably it is from 2 to 6. The actual value for this ratio will be determined, in part, by the hydroconversion process used to prepare the gas oil from the Fischer-Tropsch synthesis product. Some cyclic paraffins may also be present.

A Fischer-Tropsch derived gas oil useable in the present invention will typically have a density from 0.76 to 0.79 g/cm$^3$ at 15° C.; a cetane number (ASTM D613) greater than 70, suitably from 74 to 85; a kinematic viscosity (ASTM D445) from 2 to 4.5, preferably from 2.5 to 4.0, more preferably from 2.9 to 3.7, centistokes at 40° C.; and a sulphur content (ASTM D2622) of 5 ppmw or less, preferably of 2 ppmw or less.

Preferably it is a product prepared by a Fischer-Tropsch methane condensation reaction using a hydrogen/carbon monoxide ratio of less than 2.5, preferably less than 1.75, more preferably from 0.4 to 1.5, and ideally using a cobalt containing catalyst. Suitably it will have been obtained from a hydrocracked Fischer-Tropsch synthesis product (for instance as described in GB-B-2077289 and/or EP-A-0147873), or more preferably a product from a two-stage hydroconversion process such as that described in EP-A-

0583836 (see above). In the latter case, preferred features of the hydroconversion process may be as disclosed at pages 4 to 6, and in the examples, of EP-A-0583836.

A fuel composition according to the invention may include a mixture of two or more Fischer-Tropsch derived gas oils.

The Fischer-Tropsch derived kerosene fuel product, and any other fuel component(s) present in the composition, will suitably all be in liquid form under ambient conditions.

The fuel composition will preferably be, overall, a low or ultra low sulphur fuel composition, or a sulphur free fuel composition, for instance containing at most 500 ppmw, preferably no more than 350 ppmw, most preferably no more than 100 or 50 ppmw, or even 10 ppmw or less, of sulphur.

Where the fuel composition is an automotive diesel fuel composition, it preferably falls within applicable current standard specification(s) such as for example EN 590:99. It suitably has a density from 0.82 to 0.845 g/cm$^3$ at 15° C.; a final boiling point (ASTM D86) of 360° C. or less; a cetane number (ASTM D613) of 51 or greater; a kinematic viscosity (ASTM D445) from 2 to 4.5 centistokes at 40° C.; a sulphur content (ASTM D2622) of 350 ppmw or less; and/or a total aromatics content (IP 391(mod)) of less than 11.

A fuel composition according to the invention preferably contains 50% v/v or greater of the non-Fischer-Tropsch derived diesel base fuel, more preferably 70% v/v or greater, yet more preferably 75% v/v or greater, or 80% v/v or greater, or 85% v/v or greater, or 90% v/v or greater, or 95% v/v or greater, or 97% v/v or greater or 98% v/v or greater. The maximum concentration of the non-Fischer-Tropsch derived diesel base fuel is suitably up to 99% v/v. Thus the non-Fischer-Tropsch derived diesel base fuel may be present in the range of from 50 to 99% v/v. The amount will suitably represent the balance once the desired amount of Fischer-Tropsch derived fuel components are included as discussed below.

The fuel composition may contain up to 50% v/v of the Fischer-Tropsch derived kerosene fuel product, preferably up to 40 or up to 30% v/v, more preferably up to 20% v/v and yet more preferably up to 15% v/v or up to 10% v/v. In some instances, it may be suitable for the fuel composition to contain up to 8% v/v of the Fischer-Tropsch derived kerosene fuel product, and preferably up to 6% v/v or up to 5% v/v or up to 3% v/v or up to 2% v/v. In a particular embodiment, the concentration of the Fischer-Tropsch derived kerosene fuel product may 2% v/v or less, for instance, as low as 1% v/v or 0.5% v/v or 0.2% v/v. Suitable concentrations may lie in the range from 0.5 to 20% v/v, such as from 0.5 to 18% v/v or from 1 to 15% v/v.

The precise amount of Fischer-Tropsch derived kerosene fuel product used will depend upon the desired fuel characteristics. For example, where high power acceleration is required of the fuel, the amount of Fischer-Tropsch derived kerosene fuel product included may be low, for example in the range from 0.5 to 5 or 10% v/v, such as from 1 to 3% v/v.

However, where low density is required, to ensure low vehicle emissions, higher amounts, for instance from 5 to 15% v/v, may be preferable.

The fuel composition may contain up to 50% v/v of a Fischer-Tropsch derived gas oil, for example from 1 to 49% v/v, preferably up to 40 or 30% v/v, more preferably up to 20 or up to 15% v/v or up to 10% v/v or up to 9% v/v or up to 8% v/v or up to 5% v/v. The concentration of the Fischer-Tropsch derived gas oil, if present, may be as low as 2% v/v, for example, as low as 1% v/v, for instance down to 0.5% v/v or even as low as 0.2% v/v. Suitable concentrations may lie in the range from 0.5 to 50% v/v, for example from 1 to 50% v/v, more suitably from 2 to 30% v/v such as from 2 to 18% v/v, preferably from 3 to 15% v/v for example from 5 to 15% v/v.

A particularly preferred composition contains up to 20% v/v (say from 0.5 to 20% v/v, more preferably from 1 to 15% v/v) of a Fischer-Tropsch derived fuel blend, the blend containing both a Fischer-Tropsch derived kerosene fuel product and a Fischer-Tropsch derived gas oil. The ratio of the kerosene fuel to the gas oil may be from 1:10 to 10:1, for example from 1:5 to 5:1 or from 1:2 to 2:1. Particularly suitable ranges are from 1:5 to 1:1, for instance from 1:3 or 1:2 to 1:1. A blend containing a Fischer-Tropsch derived kerosene fuel product and a Fischer-Tropsch derived gas oil is ideally incorporated into the overall fuel composition at a concentration of from 1 to 50% v/v, for instance from 1 to 30% v/v, preferably from 1 to 20% v/v, and more preferably from 5 to 15% v/v.

Another preferred composition contains no Fischer-Tropsch derived gas oil, and so a Fischer-Tropsch derived kerosene fuel product is used alone.

All concentrations, unless otherwise stated, are quoted as percentages of the overall fuel composition.

The concentrations of the Fischer-Tropsch derived kerosene fuel product, and if present of the Fischer-Tropsch derived gas oil, will generally be chosen to ensure that the density, cetane number, calorific value and/or other relevant properties of the overall fuel composition are within the desired ranges, for instance within commercial or regulatory specifications.

A diesel fuel composition according to the present invention may contain other components in addition to the non-Fischer-Tropsch derived diesel base fuel and the Fischer-Tropsch derived fuel(s).

The base fuel may itself be additivated (additive-containing) or unadditivated (additive-free). If additivated, e.g. at the refinery, it will contain minor amounts of one or more additives selected for example from anti-static agents, pipeline drag reducers, flow improvers (e.g. ethylene/vinyl acetate copolymers or acrylate/maleic anhydride copolymers), lubricity additives, antioxidants and wax anti-settling agents.

Detergent-containing diesel fuel additives are known and commercially available. Such additives may be added to diesel fuels at levels intended to reduce, remove, or slow the build up of engine deposits.

Examples of detergents suitable for use in fuel additives for the present purpose include polyolefin substituted succinimides or succinamides of polyamines, for instance polyisobutylene succinimides or polyisobutylene amine succinamides, aliphatic amines, Mannich bases or amines and polyolefin (e.g. polyisobutylene) maleic anhydrides. Succinimide dispersant additives are described for example in GB-A-960493, EP-A-0147240, EP-A-0482253, EP-A-0613938, EP-A-0557516 and WO-A-98/42808. Particularly preferred are polyolefin substituted succinimides such as polyisobutylene succinimides.

The additive may contain other components in addition to the detergent. Examples are lubricity enhancers; dehazers, e.g. alkoxylated phenol formaldehyde polymers; anti-foaming agents (e.g. polyether-modified polysiloxanes); ignition improvers (cetane improvers) (e.g. 2-ethylhexyl nitrate (EHN), cyclohexyl nitrate, di-tert-butyl peroxide and those disclosed in U.S. Pat. No. 4,208,190 at column 2, line 27 to column 3, line 21); anti-rust agents (e.g. a propane-1,2-diol semi-ester of tetrapropenyl succinic acid, or polyhydric alcohol esters of a succinic acid derivative, the succinic acid derivative having on at least one of its alpha-carbon atoms an unsubstituted or substituted aliphatic hydrocarbon group containing from 20 to 500 carbon atoms, e.g. the pentaerythritol diester of polyisobutylene-substituted succinic acid); corrosion inhibitors; reodorants; anti-wear additives; anti-oxidants (e.g. phenolics such as 2,6-di-tert-butylphenol, or phenylenediamines such as N,N'-di-sec-butyl-p-phenylenediamine); metal deactivators; and combustion improvers.

It is particularly preferred that the additive include a lubricity enhancer, especially when the fuel composition has a low (e.g. 500 ppmw or less) sulphur content. In the additivated fuel composition, the lubricity enhancer is conveniently present at a concentration of less than 1000 ppmw, preferably between 50 and 1000 ppmw, more preferably between 100 and 1000 ppmw. Suitable commercially available lubricity enhancers include ester- and acid-based additives. Other lubricity enhancers are described in the patent literature, in particular in connection with their use in low sulphur content diesel fuels, for example in:

the paper by Danping Wei and H. A. Spikes, "*The Lubricity of Diesel Fuels*", Wear, III (1986) 217-235;

WO-A-95/33805—cold flow improvers to enhance lubricity of low sulphur fuels;

WO-A-94/17160—certain esters of a carboxylic acid and an alcohol wherein the acid has from 2 to 50 carbon atoms and the alcohol has 1 or more carbon atoms, particularly glycerol monooleate and di-isodecyl adipate, as fuel additives for wear reduction in a diesel engine injection system;

U.S. Pat. No. 5,490,864—certain dithiophosphoric diester-dialcohols as anti-wear lubricity additives for low sulphur diesel fuels; and.

WO-A-98/01516—certain alkyl aromatic compounds having at least one carboxyl group attached to their aromatic nuclei, to confer anti-wear lubricity effects particularly in low sulphur diesel fuels.

It is also preferred that the additive contain an anti-foaming agent, more preferably in combination with an anti-rust agent and/or a corrosion inhibitor and/or a lubricity additive.

Unless otherwise stated, the (active matter) concentration of each such additional component in the additivated fuel composition is preferably up to 10000 ppmw, more preferably in the range from 0.1 to 1000 ppmw, advantageously from 0.1 to 300 ppmw, such as from 0.1 to 150 ppmw.

The (active matter) concentration of any dehazer in the fuel composition will preferably be in the range from 0.1 to 20 ppmw, more preferably from 1 to 15 ppmw, still more preferably from 1 to 10 ppmw, advantageously from 1 to 5 ppmw. The (active matter) concentration of any ignition improver present will preferably be 2600 ppmw or less, more preferably 2000 ppmw or less, conveniently from 300 to 1500 ppmw.

If desired, the additive components, as listed above, may be co-mixed, preferably together with suitable diluent(s), in an additive concentrate, and the additive concentrate may be dispersed into the fuel, in suitable quantity to result in a composition of the present invention.

In the case of a diesel fuel composition, for example, the additive will typically contain a detergent, optionally together with other components as described above, and a diesel fuel-compatible diluent, which may be a carrier oil (e.g. a mineral oil), a polyether, which may be capped or uncapped, a non-polar solvent such as toluene, xylene, white spirits and those sold by Shell companies under the trade mark "SHELLSOL", and/or a polar solvent such as an ester and, in particular, an alcohol, e.g. hexanol, 2-ethylhexanol, decanol, isotridecanol and alcohol mixtures such as those sold by Shell companies under the trade mark "LINEVOL", especially LINEVOL 79 alcohol which is a mixture of $C_{7-9}$ primary alcohols, or a $C_{12-14}$ alcohol mixture which is commercially available.

The total content of the additives may be suitably between 0 and 10000 ppmw and preferably below 5000 ppmw.

Incorporating a Fischer-Tropsch derived kerosene fuel product in a diesel fuel composition has been found to provide a number of advantages, including when the kerosene is used at least partially to replace a Fischer-Tropsch derived gas oil. Fischer-Tropsch derived kerosene fuel products have lower densities than both petroleum derived diesel base fuels and Fischer-Tropsch derived gas oil (diesel) fuels; thus in blends with other fuel components they will reduce the overall blend density accordingly. Lower density in turn results in lower vehicle emissions during use, in particular lower particulates and black smoke emissions.

Fischer-Tropsch derived kerosene fuels also have significantly better cold flow properties than Fischer-Tropsch derived diesel fuels. Thus again in a blend with other fuel components, a given proportion of Fischer-Tropsch derived kerosene fuel product can result in an improvement in the cold flow properties of the overall blend, the improvement being greater than that which would result from including the same proportion of Fischer-Tropsch derived diesel instead. Improved cold flow properties increase the range of climatic conditions or seasons in which a fuel can efficiently be used.

It is already known to incorporate into some diesel fuel compositions a relatively small amount of a refinery (i.e. petroleum derived) light gas oil stream, which is essentially similar to a refinery kerosene stream. The amounts of such light fuels that can be included are severely limited because of the intrinsically low cetane numbers of the fuels, typically in the range from 40 to 48; since commercial grade diesel fuel compositions need to meet ever increasing cetane specifications (in Europe, for instance, the specification was raised in 2000 to a range of from 49 to 51), a petroleum derived kerosene fuel would typically need to be blended with a diesel base fuel of cetane number higher than the desired specification in order to be fit for commercial use.

Fischer-Tropsch derived kerosene fuels however bring no such constraints; they typically have cetane numbers of from 63 to 75 (as measured by either ASTM D613 or IP 498[IQT]), for example from 65 to 69 for a narrow-cut fraction, and from 68 to 73 for a full cut fraction, as outlined above.

A further advantage of blending a Fischer-Tropsch derived fuel component with a non-Fischer-Tropsch derived diesel base fuel, in particular a petroleum derived base fuel, is that in certain cases this can lead to improved performance in an engine or vehicle running on the resultant blend, as compared to its performance when running on the base fuel alone. This effect is particularly marked at certain concentrations where the increase in cetane number and calorific value due to the Fischer-Tropsch derived component is not yet offset by the decrease it causes in the density of the blend. The effect, manifested for instance by reduced acceleration times, has been observed for blends containing a Fischer-Tropsch derived gas oil (especially at concentrations around 15% v/v) and for blends containing a Fischer-Tropsch derived kerosene fuel product (especially at concentrations around 2% v/v).

A second aspect of the present invention therefore provides the use of a Fischer-Tropsch derived kerosene fuel product as a blend component in a fuel composition, for one or more of the following purposes:

(i) to improve the performance of a combustion engine or vehicle which is running or intended to be run on the fuel composition;

(ii) to reduce emissions from a combustion engine or vehicle which is running or intended to be run on the fuel composition;

(iii) to improve the cold flow performance of the fuel composition;

(iv) to increase the cetane number of the fuel composition.

The Fischer-Tropsch derived kerosene fuel product may be used for two or more of the purposes (i) to (iv). Preferably it is used for at least purpose (i), more preferably for purpose (i) and at the same time for one or more, ideally two or more, of the purposes (ii) to (iv).

In the context of this second aspect of the invention, "use" of a Fischer-Tropsch derived kerosene fuel product in a fuel composition means incorporating the Fischer-Tropsch derived kerosene fuel product into the composition, typically as a blend (i.e. a physical mixture) with one or more other fuel components (in particular a non-Fischer-Tropsch derived—for instance petroleum derived—diesel base fuel) and optionally with one or more fuel additives. The Fischer-Tropsch derived kerosene fuel product is conveniently incorporated before the composition is introduced into an internal combustion engine or other system which is to be run on the composition. Instead or in addition the use may involve running an engine on the fuel composition containing the Fischer-Tropsch derived kerosene fuel product, typically by introducing the composition into a combustion chamber of the engine.

The fuel composition is preferably a diesel fuel composition. Typically it will contain a petroleum derived diesel base fuel, and/or other diesel fuel components such as vegetable oils or other so-called "biodiesel" fuels.

In the context of purpose (i) above, an improvement in engine performance will generally correspond to an improvement in the efficiency of the combustion process taking place when the engine is run on the fuel composition. It may in particular be manifested by an increase in engine power and/or a decrease in acceleration times, at least in certain gears and/or at certain revolution speeds. Such properties may be measured using standard techniques, for instance as described in Example 3 below.

Thus, improved performance may embrace improved acceleration and/or improved engine responsiveness.

The engine for which performance is assessed is ideally a compression ignition (diesel) engine, which may be of the direct injection type, for example of the rotary pump, in-line pump, unit pump, electronic unit injector or common rail type, or of the indirect injection type. The engine is preferably a common rail diesel engine.

An "improvement" in engine performance embraces any degree of improvement compared to the performance of the engine when run on the fuel composition before the Fischer-Tropsch derived kerosene fuel product is added.

In the context of purpose (ii) above, a reduction in emissions refers to levels of combustion-related emissions (such as particulates, black smoke, nitrogen oxides, carbon monoxide, gaseous (unburned) hydrocarbons and carbon dioxide) generated by an engine running on the fuel composition. In the context of the present invention, emissions of particulates and/or of black smoke are of particular interest, as are nitrogen oxides.

A "reduction" in emissions embraces any degree of reduction compared to the level of emissions generated by running an engine on the fuel composition before the Fischer-Tropsch derived kerosene fuel product is added.

Emission levels may be measured using standard testing procedures such as the European R49 or ESC or OICA (for heavy-duty engines) or ECE+EUDC or MVEG (for light-duty engines) test cycles. Ideally emissions performance is measured on a diesel engine built to comply with the Euro II standard emissions limits (1996) or with the Euro III standard limits (2000). A heavy-duty engine is particularly suitable for this purpose. Gaseous and particle emissions may be determined using for instance a Horiba Mexa™ 9100 gas measurement system and an AVL Smart Sampler™ respectively. Black smoke emissions can be tested for instance using ELR which is the European test for heavy-duty engines which became effective in 2000, and is used for smoke opacity determination during emission certification of heavy-duty diesel engines {Directive 1999/96/EC of Dec. 13, 1999].

In the context of purpose (iii) above, "improving" embraces any degree of improvement compared to the cold flow performance of the fuel composition before the Fischer-Tropsch derived kerosene fuel product is added.

The cold flow performance of the fuel composition is suitably assessed by measuring its cold filter plugging point (CFPP) and/or its cloud point, preferably using the standard test methods IP 309 and IP 219 respectively. The CFPP of a fuel indicates the temperature at and below which wax in the fuel will cause severe restrictions to flow through a filter screen, and correlates well with vehicle operability at lower temperatures. An improvement in cold flow performance will correspond to a reduction in the CFPP and/or the cloud point.

In the context of purpose (iv) above, "increasing" the cetane number of the fuel composition embraces any degree of increase in the cetane number compared to that of the fuel composition before the Fischer-Tropsch derived kerosene fuel product is added. Cetane number may be measured using standard techniques, for example by either ASTM D613 or IP 498 [IQT] mentioned above.

When the fuel composition contains only a diesel base fuel and the Fischer-Tropsch derived kerosene fuel product, the second aspect of the invention embraces the addition of the kerosene fuel product so as to improve the emissions performance and/or the cold flow performance and/or the cetane number of the base fuel alone, and/or to improve the performance of an engine or vehicle running on the base fuel alone.

The Fischer-Tropsch derived kerosene fuel product may be added for the purpose of improving vehicle or engine performance without undue, or ideally without any, increase in engine emissions and/or without undue, or ideally without any, reduction in cold flow performance. It may be added for the purpose of reducing emissions and/or improving cold flow performance, without undue, or ideally without any, impairment of vehicle or engine performance—there may indeed be an associated improvement in performance.

It may in particular be added for the purpose of improving front-end volatility of the fuel composition, without undue, or ideally without any, reduction in cetane number and/or without undue, or ideally without any, impairment of vehicle or engine performance—there may indeed be an associated improvement in performance.

According to a third aspect of the invention, there is provided the use of a Fischer-Tropsch derived kerosene fuel product as a blend component in a fuel composition, preferably a diesel fuel composition, for the purpose of reducing the amount of any Fischer-Tropsch derived gas oil in the composition. In other words, the Fischer-Tropsch derived kerosene fuel product may be used at least partly in place of a Fischer-Tropsch derived gas oil which would otherwise have been present in the composition. The fuel composition may typically contain a non-Fischer-Tropsch derived diesel base fuel, in particular a petroleum derived diesel base fuel.

In the context of this third aspect of the invention, the term "reducing" embraces reduction to zero; in other words, the Fischer-Tropsch derived kerosene fuel product may be used to replace the Fischer-Tropsch derived gas oil either partially or completely. The reduction may be as compared to the level of the gas oil which would otherwise have been incorporated into the fuel composition in order to achieve the properties and performance required and/or desired of it in the context of its intended use. This may for instance be the level of the gas oil which was present in the fuel composition prior to the realisation that a Fischer-Tropsch derived kerosene fuel product could be used in the way provided by the present invention, and/or which was present in an otherwise analogous fuel composition intended (eg, marketed) for use in an analogous context, prior to adding a Fischer-Tropsch derived kerosene fuel product to it.

In the case for example of a diesel fuel composition intended for use in an automotive engine, certain minimum cetane numbers and densities may be desirable in order for the composition to meet current fuel specifications, and/or to safeguard engine performance, and/or to satisfy consumer demand; certain standards of cold flow and emissions performance may be desirable for similar reasons. According to the present invention, such standards may still be achieved even when a Fischer-Tropsch derived gas oil component is at least partially replaced by a Fischer-Tropsch derived kerosene fuel product.

According to a fourth aspect of the present invention, there is provided a process for the preparation of a fuel composition, such as a composition according to the first aspect, which process involves blending a non-Fischer-Tropsch derived diesel base fuel, suitably a petroleum derived diesel base fuel, with a Fischer-Tropsch derived kerosene fuel product and optionally with one or more fuel additives. These components may also be blended with a Fischer-Tropsch derived gas oil. The blending is ideally carried out for one or more of the purposes (i) to (iv) described in connection with the second aspect of the invention, either in relation to the properties of the fuel composition and/or to its effect on an engine into which it is or is intended to be introduced.

A fifth aspect of the invention provides a method of operating an internal combustion engine, and/or a vehicle which is driven by an internal combustion engine, which method involves introducing into a combustion chamber of the engine a fuel composition according to the first aspect of the invention. The fuel composition is preferably introduced for one or more of the purposes (i) to (iv) described above in connection with the second aspect of the invention.

The engine is preferably a compression ignition (diesel) engine. Such a diesel engine may be of the direct injection type, for example of the rotary pump, in-line pump, unit pump, electronic unit injector or common rail type, or of the indirect injection type. It may be a heavy or a light duty diesel engine.

Preferred features of the second and subsequent aspects of the invention may be as described in connection with any of the other aspects, in particular the first aspect.

The present invention will be further understood from the following examples, which illustrate the properties and performance of diesel fuel compositions in accordance with the invention.

Example 1

Table 1 below shows experimental measurements which compare and contrast the properties of a typical commercially available Fischer-Tropsch derived (GTL) kerosene fuel product (available from Shell Bintulu plant, Malaysia) with those of a hydrotreated refinery kerosene (Shell Pernis refinery, Holland).

Table 2 shows similar experimental measurements for a GTL diesel (gas oil) fuel, available from Shell Bintulu plant, Malaysia.

TABLE 1

| | Test method | Refinery kerosene | GTL kerosene |
|---|---|---|---|
| Fuel property | | | |
| Density @ 15° C. (kg/m$^3$) | IP 365/ ASTM D4052 | 793.3 | 736.1 |
| Freezing point (° C.) | IP 16/ ASTM D2386 | −48 | −53.5 |
| Flash point, Abel (° C.) | IP 170 | 44.0 | 42.0 |
| Kinematic viscosity @ −20° C. (centistokes) | IP 71/ ASTM D445 | 4.000 | 2.474 |
| Kinematic viscosity @ 40° C. (centistokes) | IP 71/ ASTM D445 | 1.245 | 0.925 |
| Cetane number | EN ISO 5165: 1998 | 48.4 | 64.5 |
| Distillation (° C.): | IP 123/ ASTM D86 | | |
| IBP | | 153 | 152.5 |
| 10% recovered | | 174.5 | 159.5 |
| 50% recovered | | 200.5 | 167.0 |
| 90% recovered | | 244.5 | 185.5 |
| FBP | | 256 | 208.0 |
| Residue/loss (% v/v) | | 1.0/0.0 | 1.0/0.0 |
| Composition: | | | |
| FIA aromatics (% v/v) | IP 156/ ASTM D1319 | 17.1 | <0.1 |
| Carbon content (% w/w) | ASTM D5291-02 | 86.2 | 84.7 |
| Hydrogen content (% w/w) | ASTM D5291-02 | 14.1 | 15.6 |
| C:H ratio | | 1:2.0 | 1:2.2 |
| Total sulphur (mg/kg) | ASTM D2622 | 201 | <5 |
| Mercaptan sulphur (% w/w) | ASTM D3227/ IP 342 | 0.0002 | 0.0002 |

TABLE 2

| Fuel property | Test method | GTL diesel |
|---|---|---|
| Density @ 15° C. (g/cm$^3$) | IP 365/ ASTM D4052 | 0.7846 |
| Distillation (° C.): | IP 123/ ASTM D86 | |
| IBP | | 219.5 |
| 10% | | 245.9 |
| 20% | | 258.8 |
| 30% | | 270.1 |
| 40% | | 282.5 |
| 50% | | 295.2 |
| 60% | | 307.2 |
| 70% | | 317.7 |
| 80% | | 328.1 |
| 90% | | 342.1 |
| 95% | | 353 |
| FBP | | 358.2 |
| Derived cetane number | IP 498 [IQT] | 82.8 |
| CCI | IP 364/84 | 90.4 |
| CCI | IP 380/94 | 90.5 |
| Kinematic viscosity @ 40° C. (centistokes) | IP 71/ ASTM D445 | 3.497 |
| Cloud point (° C.) | IP 219 | −0.5 |
| CFPP (° C.) | IP 309 | −1 |
| Sulphur (WDXRF) (mg/kg) | ASTM D2622 | Typically <5 |
| Carbon (% w/w) | ASTM D5291-02 | 85.0 |
| Hydrogen (% w/w) | ASTM D5291-02 | 15.0 |
| C:H ratio | | 2.100 |
| Flash point (° C.) | IP 34 | 101 |

In the above table, "CCI" refers to the Calculated Cetane Index, which is essentially an estimate of the cetane number from fuel physical properties.

Comparing the properties of the GTL kerosene and diesel fuels, it can be seen that:

a) the density of the GTL kerosene is significantly lower than that of the GTL diesel fuel. Thus when blending the GTL fuels with a base fuel, a given volume of the kerosene will result in an overall blend density lower than that of a blend containing the same volume of the GTL diesel. This in turn will lead to lower emissions, especially particulate matter and black smoke emissions, from an engine running on the kerosene containing blend. Thus a reduction in emissions can be achieved by replacing at least some of the GTL diesel fuel in a blend by a GTL kerosene component.

b) the cetane number of the GTL kerosene is much higher than that of the refinery kerosene. This makes the GTL kerosene a superior blending component for use in finished diesel fuel compositions, for which cetane number is such a key property.

c) the GTL kerosene also has a lower freeze point than the refinery kerosene (freeze point being analogous in this context to the cloud point of a conventional diesel base fuel). More importantly, its freeze point is much lower than the cloud point of the GTL diesel fuel. Thus again, an improvement in cold flow performance can be achieved by replacing at least some of the GTL diesel fuel in a blend by a GTL kerosene component.

Example 2

Two fuel compositions were prepared by blending GTL fuel components (obtained from Shell FT plant in Bintulu, Malaysia) with a commercially available refinery (i.e. petroleum derived) diesel base fuel, obtained from Hungary. Blend A contained the base fuel with 15% v/v (based on the overall composition) of a GTL diesel fuel. Blend B contained the base fuel with 10% v/v of the same GTL diesel fuel and 5% v/v of a GTL kerosene fuel.

The properties of the base fuel, the GTL fuel components and of the two blends A and B are summarised in Table 3 below.

TABLE 3

| Fuel property | Test method | Base fuel | GTL | Blend A | Blend B |
|---|---|---|---|---|---|
| Density @ 15° C. (g/cm$^3$) | IP 365/ ASTM D4052 | 0.8392 | 0.7852 | 0.8311 | 0.8289 |
| Distillation (° C.): | IP 123/ ASTM D86 | | | | |
| IBP | | 182.2 | 211.5 | 189.6 | 172.1 |
| 10% | | 217 | 249.0 | 220.8 | 209 |
| 20% | | 231.9 | 262.0 | 236 | 226.6 |
| 30% | | 245.4 | 274.0 | 249.6 | 242.3 |
| 40% | | 258.6 | 286.0 | 262.7 | 257.6 |
| 50% | | 272.7 | 298.0 | 276.3 | 272.3 |
| 60% | | 287.4 | 307.5 | 290.7 | 287.4 |
| 70% | | 303.4 | 317.0 | 306.6 | 303.5 |
| 80% | | 321 | 326.5 | 322.2 | 320.6 |
| 90% | | 342.2 | 339.0 | 341.6 | 340.9 |
| 95% | | 357.2 | 349.0 | 355.8 | 356.1 |
| FBP | | 368.6 | 354.5 | 363.8 | 367.3 |

TABLE 3-continued

| Fuel property | Test method | Base fuel | GTL | Blend A | Blend B |
|---|---|---|---|---|---|
| Derived cetane number | IP 498 [IQT] | 54.1 | — | 59.3 | 58.4 |
| CCI IP 364/84 | | | 77.2 | | |
| CCI IP 380/94 | | 52.4 | 91.6 | 56.7 | 55.9 |
| Kinematic viscosity @ 40° C. (centistokes) | IP 71/ ASTM D445 | 2.955 | 3.606 | 3.027 | 2.796 |
| Sulphur (% w/w or mg/kg) | ASTM D2622 | 304 | <5 | 275 | 273 |
| Flash point (° C.) | IP 34 | 77 | 91 | 78 | 73 |

Table 3 illustrates that Blend B containing GTL kerosene has a significantly lower density than either Blend A (containing only GTL diesel) or the base fuel. As a result, Blend B can be expected to cause significantly lower black smoke and particulate matter emissions from a vehicle running on the fuel.

Generally speaking, a lower boiling point fuel stream will tend to have a lower cetane number than a higher boiling point stream with a similar hydrocarbon composition—thus, for instance, a GTL kerosene fuel will have a lower cetane number than a GTL gas oil (diesel fuel). In this case, however, the fuel Blend B can be seen to have only a marginally lower cetane number than Blend A, and its cetane number is still significantly higher than that of the base fuel alone. Thus, 5% v/v of the GTL diesel can be substituted by the GTL kerosene component without undue reduction in cetane number. In contrast, the use of a refinery kerosene in a similar manner would lead to a much greater reduction in cetane number. This demonstrates the suitability of GTL kerosene for inclusion in diesel fuel compositions.

Example 3

Good front-end volatility in a diesel fuel should be an asset in the promotion of air/fuel mixing, thus leading to efficient combustion. However, when a more volatile fuel such as refinery kerosene is blended with a conventional diesel fuel in order to improve front-end volatility, the low cetane number of the added fuel component in fact has a negative impact on combustion.

Fischer-Tropsch derived kerosene, in contrast, is not only more volatile than conventional diesel base fuels but also has a higher cetane number. These two properties combined have been found to result in a better combustion event. Better combustion can in turn be manifested in improved acceleration times for a vehicle running on the relevant fuel composition.

The effect of fuel compositions according to the invention on engine performance was assessed using a Renault™ Kangoo™, having a common rail diesel engine and pre-ignition. This vehicle was chosen for its good repeatability and its previously observed sensitivity to changes in fuel quality. No modifications were made to the engine or fuel injection system for this test. The test vehicle was representative of standard production vehicles.

A conventional petroleum derived diesel base fuel (BF) (available from Deutsche Shell, Harburg) was blended with various amounts of (a) a GTL diesel (gas oil) and (b) a GTL kerosene fuel, (both obtained from Shell FT plant in Bintulu, Malaysia) to yield test fuels F1 to F6 having the properties summarised in Table 4.

TABLE 4

| Property | Base fuel (BF) | F1 | F2 | F3 | F4 | F5 | F6 |
|---|---|---|---|---|---|---|---|
| Amount of GTL diesel (% v/v) | N/A | 2 | 5 | 15 | 0 | 0 | 0 |
| Amount of GTL kerosene (% v/v) | N/A | 0 | 0 | 0 | 2 | 5 | 15 |
| Density (kg/m$^3$) | 830.0 | 829.0 | 827.8 | 823.5 | 828.2 | 825.2 | 816.4 |
| Sulphur content (% w/w) | 0.0008 | | | | | | |
| Cetane number (BASF) | 58.7** | 57.5 | 58.0 | 58.8 | 56.0 | 56.5 | 58.0 |
| Lower heating value (MJ/kg) | 42.87*** | 42.81 | 42.92 | 42.97 | 42.90 | 42.98 | 43.10 |
| Initial boiling point (° C.) | 174.3 | Same | Same | Same | 150* | 150* | 150* |
| T50 (° C.) | 273.0 | | | | | | |
| T95 (° C.) | 346.5 | | | | | | |
| Final boiling point (° C.) | 359.8 | Same | Same | Same | Same | Same | Same |
| Viscosity @ 40° C. (mm$^2$/s) | 2.826 | 2.826* | 2.828* | 2.844* | 2.751* | 2.640* | 2.298* |

*Estimated value

**Cetane numbers were measured several weeks before the other properties, which may explain the high value for the base fuel as compared to that for the test fuel F1 containing 2% v/v GTL diesel.

***The heating value (calorific value) was measured at the same time as the other properties and was determined by IP12. The value for the base fuel appears relatively high, but differences are still within the accuracy of the test procedure.

Test methods used were similar to those set out in Table 3 above. Specifically, density was measured using IP 365, ASTM D4052, distillation was by IP 123, ASTM D86 and total sulphur using ASTM D2622.

In this case, however, the cetane number was determined using the BASF engine test, DIN 51773.

The test vehicle described above was run on each of the test fuels and in each case, acceleration times were measured in 3rd, 4th and 5th gears. Power was also assessed in 4th gear at 1500, 2500 and 3500 rpm.

Specifically, the vehicle was installed on a chassis dynamometer, using an inertia setting equivalent to the nominal weight of the vehicle plus driver, and rolling resistance and wind—20 resistance settings calculated from the observed "coast-down" speed of the vehicle on level ground.

The vehicle was driven on the dynamometer until coolant and oil temperatures had stabilized.

Acceleration times were measured from 32-80 km/hr (20-50 mph) in 3rd gear, from 48-96 km/hr (30-60 mph) in 4th gear and from 80-112 km/hr (50-70 mph) in 5th gear.

The vehicle was driven at constant speed just below the starting speed in the chosen gear. The throttle pedal was fully depressed and the vehicle allowed to accelerate to just above the final speed in the chosen gear. Time (to the nearest 0.1 second) and speed were recorded by the chassis dynamometer data acquisition system, and the time taken to pass between the two speed "gates" was calculated.

Three accelerations were measured in each gear with each fuel tested and the average acceleration time was calculated.

The testing was spread over three days, according to the following scheme:

Day 1: BF-F1-F2-BF-F3-F2-BF-F1-F3-BF.

Day 2: BF-F3-F2-BF-F1-F4-BF-F5-F6-BF.

Day 3: BF-F5-F4-BF-F6-F5-BF-F4-F6-BF.

This gave in total 12 data series for the base fuel BF and three data series for each of the test fuels. The data are summarised in Table 5 below, which quotes acceleration times normalised with respect to those measured for the base fuel.

The table also indicates theoretical values for acceleration time, calculated from the relative densities and calorific values of the components of each test fuel and their relative proportions (assuming in both cases a linear relationship between the relevant property and acceleration time). Differences in viscosity have not been taken into account since these do not play a significant role in common rail engines.

TABLE 5

| | 3rd Gear acceleration | 4th Gear acceleration | 5th Gear acceleration | Theory |
|---|---|---|---|---|
| Reference fuel | 0.00% | 0.00% | 0.00% | 0 |
| 2% GTL diesel | 0.04% | −0.27% | 0.34% | 0.26% |
| 5% GTL diesel | 0.02% | −0.12% | 0.33% | 0.15% |
| 15% GTL diesel | −0.45% | −0.39% | −0.39% | 0.55% |
| Reference fuel | 0.00% | 0.00% | 0.00% | 0 |
| 2% GTL Kero | −0.18% | −0.34% | −0.07% | 0.15% |
| 5% GTL Kero | 0.02% | 0.26% | 0.31% | 0.30% |
| 15% GTL Kero | 0.50% | 0.73% | 1.23% | 1.10% |

In Table 5, normalised acceleration times are provided. For the theoretical values differences in density and calorific value are taken into account. The results are given as percentage difference from the reference fuel.

Test fuels F1 and F2, containing respectively 2% and 5% v/v GTL diesel, yielded no consistent change in acceleration time. Although the acceleration times appear to be better (i.e. shorter) than the theoretical values in 4th gear and worse (i.e. longer) in 5th gear, these differences are not statistically significant. (Note also that for these two fuels the calculated theoretical acceleration times may not be accurate due to potential inaccuracies in calorific value measurements (see Table 4)).

Test fuel F3, containing 15% v/v GTL diesel, did however yield a statistically significant (95% confidence) reduction in acceleration times in both 3rd and 4th gears. This improvement in performance was significantly different to what might have been expected based purely on changes in density and calorific value. It was found, however, in separate tests, that the inclusion of more than 15% v/v of GTL diesel could lead to increases in acceleration times, presumably due to the lower density of the GTL component.

The test fuels containing GTL kerosene showed similar trends to those observed for F1 to F3. At low concentrations of GTL kerosene (F4), a reduction in acceleration times was observed—this result was statistically significant (95% confidence) in 4th gear, and again differed from the theoretical prediction. At higher concentrations, however (F5 and F6), the lower density of the kerosene component led to the expected increases in acceleration times.

These data show that a fuel composition in accordance with the present invention can cause more efficient combustion and hence improved vehicle performance. They also demonstrate the importance of optimising the concentration of the GTL component(s), in particular GTL kerosene, included in such a composition. The good volatility, high cetane number and high calorific value of the GTL kerosene, relative to those of the petroleum derived diesel base fuel, should all lead to better combustion and hence to improved acceleration. However, the relatively low density of the kerosene also leads to a reduction in the mass of fuel injected, which would cause a reduction in power. At lower kerosene concentrations, the density effect is less evident and overall, therefore, an improvement in performance results.

It is noticeable that for the GTL diesel blends, the improvement in acceleration occurs at a higher concentration (around 15% v/v) than it does for the GTL kerosene blends (between about 1 and 3% v/v). This is thought to be because of the much lower density of the kerosene component, and reflects the concentration at which the trade-off between on the one hand calorific value and cetane number, and on the other hand density, switches from advantageous to disadvantageous.

Thus at certain optimum concentrations, it is possible to blend a Fischer-Tropsch derived gas oil and/or a Fischer-Tropsch derived kerosene product with a petroleum derived diesel base fuel, in order to achieve an improvement in performance of a vehicle running on the resultant fuel composition. The optimum concentration in the case of the Fischer-Tropsch derived gas oil appears to be about 10 to 17% v/v, ideally about 15% v/v; in the case of the Fischer-Tropsch derived kerosene fuel product it appears to be about 1 to 3 v/v, ideally about 2% v/v. Ternary blends may be prepared containing both a Fischer-Tropsch derived gas oil and a Fischer-Tropsch derived kerosene fuel product, which benefit from the performance enhancing effects of both.

A further fuel composition can be prepared by blending a GTL kerosene fuel with a commercially available Swedish Class 1 petroleum derived diesel base fuel (e.g. available from Shell Gothenburg refinery, Sweden). The properties of such a Swedish Class 1 base fuel are given in Table 6 below, together with the calculated properties of a Blend C containing 20% v/v of said GTL kerosene fuel and 80% v/v of said Swedish Class 1 base fuel:

TABLE 6

| Fuel property | Test method | Swedish Class 1 | Blend C |
|---|---|---|---|
| Density @ 15° C. (g/cm$^3$) | IP 365/ ASTM D4052 | 0.811 | 0.802 |
| Distillation (° C.): | IP 123/ ASTM D86 | | |
| IBP | | 178.0 | 170.0 |
| 10% | | 203.0 | 189.0 |
| 20% | | 211.5 | — |
| 30% | | 219.8 | — |
| 40% | | 228.0 | — |
| 50% | | 235.8 | 228.0 |
| 60% | | 243.2 | — |
| 70% | | 250.6 | — |
| 80% | | 259.0 | — |
| 90% | | 270.3 | 267.0 |
| 95% | | 279.3 | 277.0 |
| FBP | | 290.3 | 288.0 |
| Derived cetane number | IP 498 [IQT] | 58.6 | 60.3 |
| Kinematic viscosity @ 40° C. (centistokes) | IP 71/ ASTM D445 | 2.04 | 1.88 |
| Sulphur (WDXRF) (mg/kg) | ASTM D2622 | 5.0 | 4.0 |
| Cloud point (° C.) | IP 219 | −40.0 | −41.4 |
| Flash point (° C.) | IP 34 | 41.0 | 42.2 |

To such a blend of GTL kerosene fuel and Swedish Class 1 base fuel can be added a GTL gas oil as a blend component.

We claim:

1. A fuel composition exhibiting a reduced acceleration time, the fuel composition comprising a blend comprising (a) a non-Fischer-Tropsch derived diesel base fuel having boiling points within the range of from 150 to 400° C., a density of from 0.75 to 0.9 g/cm$^3$ at 15° C., and a cetane number of from 35 to 80, and (b) a quantity of from about 0.2 v/v. % to 3 v/v. % Fischer-Tropsch derived kerosene fuel product exhibiting a distillation range of from 140 to 260° C., a density of from 0.73 to 0.76 g/cm$^3$ at 15° C., and a cetane number of from 63 to 75;

(c) the blend exhibiting a reduced acceleration time that is at least 0.20% less than a theoretical acceleration time calculated based on the relative densities, calorific values, and relative proportions of the components of the fuel composition, assuming a linear relationship between the relevant property and the theoretical acceleration time.

2. The fuel composition of claim 1 wherein the diesel base fuel is petroleum derived.

3. The fuel composition of claim 1 further comprising from 10 to 17% v/v Fischer-Tropsch derived gas oil having boiling points within the range of from 150 to 400° C., a density of from 0.76 to 0.79 at 15° C., and a cetane number of greater than 70 as a blend component.

4. The fuel composition of claim 3 wherein the concentration of the Fischer-Tropsch derived gas oil is about 15% v/v based on the overall composition.

5. The fuel composition of claim 1 wherein the fuel composition produces one or more additional improvements selected from the group consisting of:

(i) reducing emissions of the internal combustion engine;

(ii) improving cold flow performance of the fuel composition; and/or (iii) increasing cetane number of the fuel composition.

6. The fuel composition of claim 3 wherein the diesel base fuel is petroleum derived.

7. The fuel composition of claim 4 further comprising from 10 to 17% v/v. Fischer-Tropsch derived gas oil having boiling points within the range of from 150 to 400° C., a density of from 0.76 to 0.79 at 15° C., and a octane number of greater than 70 as a blend component.

8. The fuel composition of claim 7 wherein the concentration of the Fischer-Tropsch derived gas oil is about 15% v/v based on the overall composition.

9. The fuel composition of claim 1 comprising 2 v/v % or more of the Fischer-Tropsch derived kerosene fuel product.

10. The fuel composition of claim 3 wherein using the fuel composition produces one or more additional improvements selected from the group consisting of:

(i) reducing emissions of the internal combustion engine;

(ii) improving cold flow performance of the fuel composition; and/or (iii) increasing cetane number of the fuel composition.

11. A fuel composition exhibiting a reduced acceleration time, the fuel composition comprising a blend comprising (a) non-Fischer-Tropsch derived diesel base fuel having boiling points within the range of from 150 to 400° C., a density of from 0.75 to 0.9 g/cm$^3$ at 15° C., and a cetane number of from 35 to 80; and (b) from about 1 v/v. % to about 3 v/v. % Fischer-Tropsch derived kerosene fuel product exhibiting a distillation range of from 140 to 260° C., a density of from 0.73 to 0.76 g/cm$^3$ at 15° C., and a cetane number of from 63 to 75;

(c) the blend exhibiting a reduced acceleration time that is at least 0.20% less than a theoretical acceleration time calculated based on the relative densities, calorific values, and relative proportions of the components of the fuel composition assuming a linear relationship between the relevant property and the theoretical acceleration time.

12. The fuel composition of claim 11 wherein the diesel base fuel is petroleum derived.

13. The fuel composition of claim 11 further comprising from 10 to 17% v/v of Fischer-Tropsch derived gas oil having boiling points within the range of from 150 to 400° C., a density of from 0.76 to 0.79 at 15° C., and a cetane number of greater than 70 as a blend component.

14. The fuel composition of claim 4 wherein the Fischer-Tropsch derived kerosene product exhibits a distillation range of from 150 to 250° C.

15. The fuel composition of claim 4 wherein the Fischer-Tropsch derived kerosene product exhibits a distillation range of from 150 to 210° C. and a cetane number of from 65 to 69.

16. The fuel composition of claim 11 wherein the Fischer-Tropsch derived kerosene product exhibits a distillation range of from 150 to 250° C.

17. The fuel composition of claim 11 wherein the Fischer-Tropsch derived kerosene product exhibits a distillation range of from 150 to 210° C. and a cetane number of from 65 to 69.

18. The fuel composition of claim 1 wherein the Fischer-Tropsch derived kerosene product exhibits a distillation range of from 150 to 250° C.

19. The fuel composition of claim 1 wherein the Fischer-Tropsch derived kerosene product exhibits a distillation range of from 150 to 210° C. and a cetane number of from 65 to 69.

20. The fuel composition of claim 3 wherein the Fischer-Tropsch derived kerosene product exhibits a distillation range of from 150 to 250° C.

21. The fuel composition of claim 3 wherein the Fischer-Tropsch derived kerosene product exhibits a distillation range of from 150 to 210° C. and a cetane number of from 65 to 69.

* * * * *